United States Patent [19]

Hrusch

[11] 4,211,149

[45] Jul. 8, 1980

[54] SPLIT LOCK RING FOR LOCKING ACTUATOR AND METHOD FOR MANUFACTURING THE SAME

[75] Inventor: Louis C. Hrusch, Chesterland, Ohio

[73] Assignee: Pneumo Corporation, Boston, Mass.

[21] Appl. No.: 841,936

[22] Filed: Oct. 13, 1977

[51] Int. Cl.[2] ..... F15B 15/26

[52] U.S. Cl. ..... 92/27; 92/128; 188/259; 277/217

[58] Field of Search ..... 92/24, 26, 27, 23, 28, 92/128; 277/222, 217; 188/67, 78, 336, 250 H, 249, 259

[56] References Cited

U.S. PATENT DOCUMENTS

| | | | |
|---|---|---|---|
| 1,321,539 | 11/1919 | Mummert | 277/217 |
| 1,369,075 | 2/1921 | Ballman | 277/217 |
| 2,295,961 | 9/1942 | Meyer | 92/24 |
| 2,428,177 | 9/1947 | Phillips | 277/136 |
| 2,996,046 | 8/1961 | Skopp | 92/26 |
| 3,166,990 | 1/1965 | Hoffmann . | |
| 3,186,308 | 6/1965 | Butterworth . | |
| 3,552,273 | 1/1971 | Resuggan . | |
| 3,584,541 | 6/1971 | Cunningham . | |
| 3,813,065 | 5/1974 | Hallesy . | |

FOREIGN PATENT DOCUMENTS

| | | | |
|---|---|---|---|
| 866757 | 7/1949 | Fed. Rep. of Germany | 92/24 |
| 1222748 | 8/1966 | Fed. Rep. of Germany | 277/217 |

*Primary Examiner*—Abraham Hershkovitz
*Attorney, Agent, or Firm*—Maky, Renner, Otto & Boisselle

[57] ABSTRACT

A radially expandable and contractable split lock ring selectively to unlock and lock a piston and cylinder actuator includes at least one lapped axially extending surface substantially conforming to the surface of the cylinder or piston with which it is in sliding contact when in the unlocked position. The split lock ring has each of its ends slightly inwardly tapered to reduce the thickness thereof to distribute the bending load uniformly throughout the ring and has a flat on the outer diametrical surface diametrically opposed from such tapered ends to provide load carrying symmetry for the ring.

4 Claims, 5 Drawing Figures

SPLIT LOCK RING FOR LOCKING ACTUATOR AND METHOD FOR MANUFACTURING THE SAME

BACKGROUND AND SUMMARY OF THE INVENTION

The present invention relates as indicated to a split locking ring for a piston cylinder actuator in general and to a locking ring having at least one axially extending surface initially lapped in its unlocked configuration accurately to conform the same in operation to the piston or cylinder surface in sliding contact therewith during relative movement therebetween in the unlocked position of the lock ring.

To replace the conventional balls, keys and fingers previously employed as locking mechanisms for locking actuators, split locking rings have recently been adopted selectively radially to expand and contract for locking and unlocking functions in a piston cylinder actuator commonly used on or in association with aircraft landing gear and the like. An example of such a split locking ring used in such environment may be found in Hallesy et at U.S. Pat. No. 3,813,065.

In such patent, the inner diametrical surface of the split locking ring is provided with a plurality of flex notches to permit flexibility for the radial movement required and to reduce the loads necessary to attain the radial expansion and contraction for the locking and unlocking functions. However, such flex notches reduce the effective bearing area for the inner diameter of the split locking ring and are also expensive to machine.

To overcome such loss of bearing area and expense, the present invention is directed to making a split ring locking assembly that does not require inner diameter flex notches to perform the radial movements required for locking and unlocking. This movement is accomplished by selecting a split locking ring having a sufficient diameter as compared to its cross-sectional configuration to provide adequate flexibility to undergo the radial movements required.

In this regard, it is a principal object of the present invention to provide such a split locking ring having an accurately lapped outer diametrical surface to conform to the inner diameter of the cylinder in the unlocked position of the ring, whereby relative axial movement therebetween occurs with substantially uniform peripheral contact therebetween. Alternatively, if the locking and unlocking functions are obtained by oppositely directed radial movements of the ring, the inner diametrical surface of the ring can be initially lapped in its radially expanded condition thereby to conform in operation to the outer diameter of the piston in sliding contact therewith during the unlocked mode of the actuator. This outer and/or inner diameter lapping procedure in the unlocked configuration for the locking ring before assembly eliminates the detected uneven wear patterns associated with conventional split locking rings and further avoids the necessity of the inner diameter flex notches to provide the necessary flexibility to approximate conformance.

It is still another object of the present invention to avoid loading eccentricities on the split lock ring during manufacture and to provide symmetry of balance and load carrying capacity. To accomplish this function, the ends of the split locking ring are radially relieved on both the inner and outer diametrical surfaces for uniform distribution of bending loads, with a flat being provided diametrically opposed therefrom on the outer diameter to provide symmetry of balance and loading.

Other objects and advantages of the present invention will become apparent as the following description proceeds.

To the accomplishment of the foregoing and related ends the invention, then, comprises the features hereinafter fully described and particularly pointed out in the claims, the following description and the annexed drawing setting forth in detail a certain illustrative embodiment of the invention, this being indicative, however, of but one of the various ways in which the principle of the invention may be employed.

DESCRIPTION OF THE PREFERRED EMBODIMENT

Figure 1:
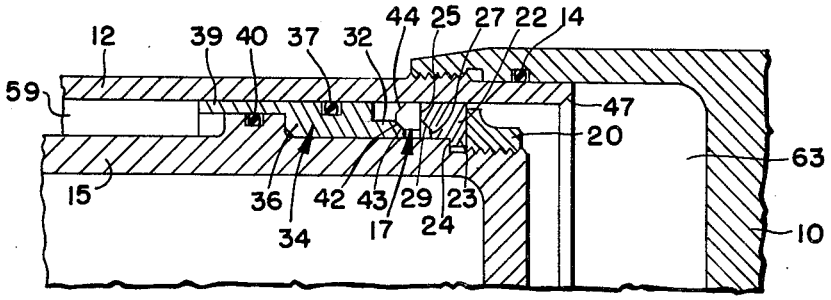
FIG. 1 is a fragmentary vertical cross section showing the lock ring in its radially contracted unlocked position to permit relative axial movement between the piston and cylinder.
Figure 2:
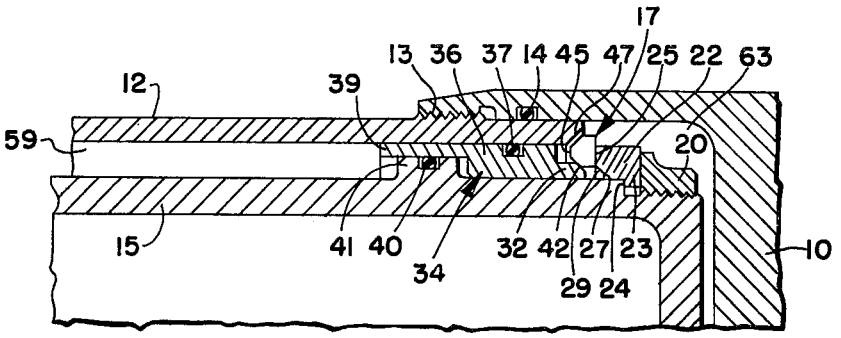
FIG. 2 is a fragmentary vertical elevation similar to FIG. 1 showing the locking ring in transition from its unlocked radially contracted position to its locked radially expanded position.
Figure 3:
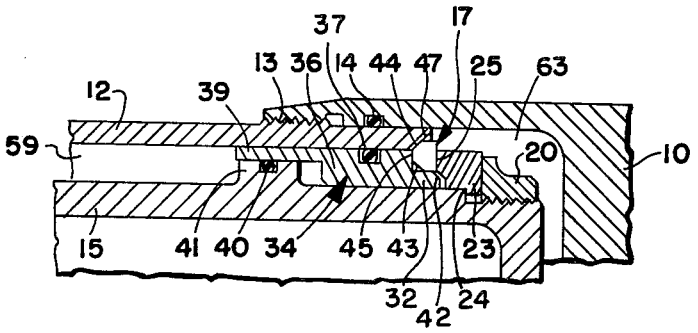
FIG. 3 is a fragmentary vertical elevation similar to FIGS. 1 and 2 showing the locking ring in its radially expanded locking position fixedly interconnecting the piston and cylinder of the actuator.

Referring now in more detail to the drawing and initially to FIGS. 1–3, the portion of the locking actuator illustrated includes an end enclosure 10 threadingly connected to and sealed against cylinder 12 as indicated at 13 and 14, respectively. Such end enclosure typically includes a mounting eye pivotally to connect the same to the mounting structure, such as an aircraft fuselage. The other end of the cylinder 12 is sealingly connected to the piston 15 that is slidably received in and of smaller diameter than such cylinder, such piston extending outwardly from the sealed open end of the cylinder for stroking relative thereto. The terminal end of the piston is suitably connected to the actuated output device, such as a landing gear in the drag brace environment described for exemplary purposes. The piston 15 is locked to the cylinder 12 in its contracted or in-stroked position by a radially expandable and contractable lock ring 17 positively driven and controlled in its movements by an actuating mechanism indicated generally at 18.

At its inner end, the piston 15 includes a threaded outer diameter for mounting the actuating mechanism 18 thereto. Specifically, a load nut 20 is screwed onto the threaded end of piston 15 firmly to secure back-up member 22 in position with the radially inwardly extending flange 23 thereon engaging the annular shoulder 24 on the outer diameter of the piston. The left side of the back-up member as illustrated includes a vertical load bearing face 25 and an inner annular groove consisting of a vertical radially inner wall 27 and a tapered wall 29 selectively to receive the correspondingly configured lead face of the actuating projection flange 32 on axially movable keeper 34.

Such keeper 34 includes a main body portion 36 having an outer diameter sealed to cylinder 12 at 37 and a finger 39 extending to the left therefrom and being sealed at 40 to a radially outwardly extending abutment 41 on the piston 15. The keeper 34 is axially slidable between the abutment 41 and the back-up member 22. As described below, such selective axial movement of the keeper permits the tapered cam face 42 on the lead face of the keeper actuating projection flange 32 radially to expand and contract the split lock ring 17 in certain relative locations of the piston and cylinder.

Figure 4:
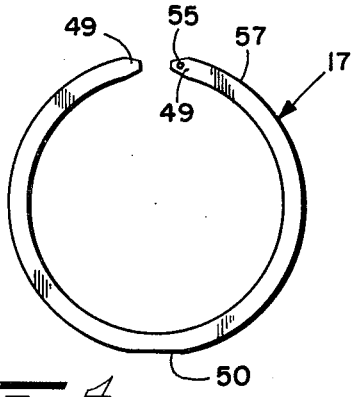
FIG. 4 is a side elevation of the lock ring of the present invention after the flat bar has been bent into its generally circular configuration.
Figure 5:
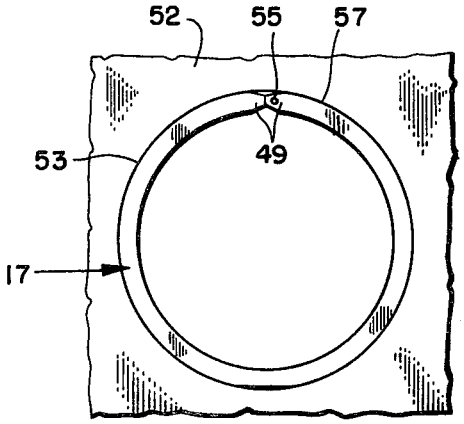
FIG. 5 is a fragmentary elevation showing the split locking ring in its radially contracted position in a lapping machine prior to assembly in the lock ring actuator.

As shown in FIGS. 4 and 5, such split lock ring is initially a flat steel bar having smooth continuous sides and sufficient length to cross sectional dimensions to provide the required radial flexibility in the desired actuator environment when the ring is bent into its final, generally circular shape. When flat, the bar is machined to provide oppositely inclined camming ramps 43 and 44 at one side thereof separated by a flat wall 45. As will be described in more detail hereinafter, such ramps cooperate respectively with the correspondingly inclined cam face 42 on keeper 34 and the tapered locking groove 47 at the end of cylinder 12 to achieve the required radial movement for the lock ring.

Prior to bending, the ends of the flat locking ring bar are provided with reductions in their thickness as indicated at 49 more uniformly to distribute the forces of bending over the entire ring. After bending, a flat 50 is formed on the outer diameter of the ring at a position diametrically opposed to the ring ends, with the volume of material removed for such flat generally corresponding to the volume of material removed for the inwardly inclined tapered surfaces adjacent the ends. Such tapered ends 49 and flat 50 thus provide symmetry of balance and load carrying capacity for the ring. Such split locking ring in its normal unloaded state has a diameter between its radially contracted unlocked position and its radially expanded locked position.

When a conventional lock ring has been applied to the actuator environment described hereinabove, it has been noted that the lock ring does not have uniform sliding contact about its periphery with the cylinder 12 during relative axial sliding therebetween in the unlocked position. More specifically, the contact between such conventional lock ring and cylinder generally occurs at three locations peripherally spaced at approximately 120° increments, with no significant contact occurring therebetween. Such uneven sliding contact between the metallic split lock ring and the metallic cylinder causes loading imbalances and eventually results in grooving of the inner diameter of the cylinder at the points of contact with consequent loss of the effectiveness of seal 37 between the keeper and the cylinder. Such loss of seal with the attendant uncontrolled flow of hydraulic fluid may result in failure of the actuator.

To overcome this noted problem, the split lock ring prior to assembly is drawn into its radially contracted unlocked position with the ends thereof abutting one another and is then placed into an outer diameter lapping machine 52 having a finishing bore therein 53 exactly conforming in diameter to the inner diameter of cylinder 12 of the actuator. If desired, a hole 55 can be drilled in one end of the split locking ring to provide a mechanism for rotating the ring relative to the lapping machine to get accurate material removal from the outer diametrical surface 57 of the ring caused by abrasion against the finishing bore 53 in well known manner. Alternatively of course, the lock ring in its radially contracted position could be axially reciprocated within the finishing bore for material removal functions. In any event, the lock ring after such outer diameter lapping treatment is removed from the lapping machine with the outer diameter thereof in its radially contracted position conforming to the inner diameter of the cylinder 12 about substantially its entire periphery. Such lapped outer diametrical surface may be flash chrome plated to provide the necessary hardness to increase the effective life for the actuator.

The parts are then installed as illustrated in FIGS. 1–3 and described hereinabove to complete the lock ring actuator assembly. The operation of the lock ring assembly is believed apparent from the above description, but a summary of the same will be given hereinafter for completeness of description.

In the unlocked extended position of the actuator illustrated in FIG. 1, the split lock ring 17 is in its radially contracted unlocked position with its outer diametrical surface 57 having uniform peripheral sliding contact with the inner diameter of cylinder 12. In such contracted position of the lock ring, the piston 15 is free axially to move relative to the cylinder in accordance with which end of the piston is being hydraulically pressurized. For example, when the left chamber 59 of FIG. 1 defined in the space between the piston 15, ring actuator mechanism 18, and cylinder 12 is filled with pressurized hydraulic fluid by a conventional hydraulic system not shown, the piston and ring actuator assembly are forced to the right toward the contracted position for the actuator. When the locking ring has cleared the inner end of the cylinder, the locking ring 17 begins a natural radial expansion movement assisted by the camming action of the keeper 34.

More specifically, at such point in piston movement, the keeper is freed for axial movement to the right because of ability for the lock ring to move radially outwardly. Such axial movement of the keeper to the right is positively attained by the hydraulic pressure in chamber 59 acting against the end of keeper finger 39. Such keeper movement results in the actuating camming face 42 thereon moving along the expansion ramp 43 of lock ring 17 to drive the same radially outwardly as indicated in FIG. 2, with such radially outwardly directed movement being guided by the vertical, load bearing face 25 on back-up member 22. When the keeper has completed its axial movement to the right as viewed in FIG. 3, the cam surface 42 of actuating flange 31 is tightly received in the correspondingly configured reception groove in back-up member 22, and the leading edge of the keeper body 36 is in abutment with the vertical face 45 of the lock ring between its actuating ramps.

In such position, the radial retraction ramp 44 on the locking ring is in abutting relationship with the correspondingly tapered lock groove 47 at the end of cylinder 12, and the right vertical face of lock ring 17 is in abutment with back-up member 22. The lock ring 17 is positively held in its radially expanded position by the keeper actuating flange 32 being radially under or inside the lock ring to support it in such position. The abutment between the lock ring and cylinder groove provides a positive lock between the piston and cylinder precluding relative axial movement therebetween.

When the actuator is selectively energized for piston outstroking, hydraulic fluid is introduced by conventional port means into the chamber 63 between the end enclosure 10, the piston 15, the lock ring actuating mechanism 18, and the cylinder 12. Such hydraulic pressure initially forces the keeper 34 axially to the left as viewed in FIGS. 1-3. Such movement to the left permits some natural radial contraction of the lock ring 17 since the actuating flange 32 is moving out from under the same. When the keeper body 36 engages the radially outwardly directed abutment 41 on piston 12, the hydraulic pressure acts directly on such piston through the actuating mechanism 18 to force the piston to the left as viewed in FIG. 3. During the initial stroking of the piston, the lock ring is forced radially inwardly by the camming movement of its radial retraction ramp 44 along the correspondingly inclined lock groove 47 on the end of cylinder 12. Such camming movement results in the locking ring being positively radially inwardly driven until the ring has attained its radially contracted final unlocked position in which the outer diameter thereof is in peripheral sliding contact with the inner diameter of the cylinder as indicated in FIG. 1. The piston is then free to stroke to the left as viewed in FIG. 1 to its final extended position.

Although the locking ring has been illustrated and described herein as having a radially contracted unlocked position and a radially expanded locking position, it will be appreciated that the present invention encompasses a mere reversal of the parts so that the split lock ring has a radially expanded unlocked position and a radially contracted locked position. In such a reversal, the inner diametrical surface of the lock ring would initially be lapped when held in its radially expanded condition so that such surface would correspond to the outer diameter of the piston member. Such inner ring surface in assembled operation would thus have a peripherally uniform sliding contact with the outer diameter of the piston when the lock ring is in its expanded, unlocked position. Conversely, in its locked position, the split locking ring would be radially contracted and received in a groove or abutted against an inclined surface in or on the piston member.

Other modes of applying the principle of the invention may be employed, change being made as regards the details described, provided the features stated in any of the following claims or the equivalent of such be employed.

I, therefore, particularly point out and distinctly claim as my invention:

1. A lock ring assembly for a piston cylinder actuator comprising a split lock ring having ends of reduced thickness formed by inwardly tapering the radially outer surface and outwardly tapering the radially inner surface uniformly to distribute the bending loads therealong and a flat on the outer diameter thereof diametrically opposite the reduced thickness ends to provide load carrying symmetry, means radially to expand and contract said lock ring selectively to lock the piston to the cylinder to fix their relative axial positions or to unlock the piston from the cylinder to permit relative axial movement therebetween with peripheral sliding contact between one axial surface of the lock ring and one diametrical surface of the piston or cylinder, such sliding surface of the lock ring by being lapped in its sliding configuration has a uniform periphery conforming to the cylinder or piston diametrical surface about substantially its entire periphery during the sliding movement.

2. The lock ring of claim 1, wherein the lock ring is steel, the outer diameter is flash chrome plated, and the inner diameter is circumferentially continuous.

3. The lock ring of claim 1 wherein the outer diameter of the lock ring is lapped when such ring is in its radially contracted position.

4. A method for assembling a split lock ring selectively to lock and unlock a piston and cylinder actuator by radial expansion and contraction comprising the steps of selecting a generally smoothly contoured, initially flat split lock ring having sufficient diameter to cross sectional configuration reliably to undergo the necessary radial movements, tapering the inner and outer surfaces of the ring to form reduced thickness ends, bending the split lock ring into a generally circular configuration having a diameter intermediate the diameters describing the minimum and maximum radial extremes for the split locking ring, forming a flat on one lock ring surface diametrically opposite the tapered ends by removing a volume of material generally equal to the material removed for the reduced thickness ends, holding the split lock ring body in the configuration corresponding to its unlocked condition, lapping one diametrical surface of the split lock ring when thus held, and assembling the thus lapped split lock ring on means radially to expand and contract the same in the piston and cylinder actuator so that the lapped surface will be received in one of the piston or cylinder parts while locked and will be in substantially uniform peripheral sliding contact with said one part while unlocked.

* * * * *